US005317000A

United States Patent [19]

Bloodworth et al.

[11] Patent Number: 5,317,000

[45] Date of Patent: May 31, 1994

[54] ACCEPTOR ELEMENT FOR THERMOSUBLIMATION PRINTING

[75] Inventors: Robert Bloodworth; Wolfgang Podszun, both of Köln, Fed. Rep. of Germany; Geert Defieuw, Kessel; Herman Uytterhoeven, Bonheiden, both of Belgium; Hans Schulze, Köln, Fed. Rep. of Germany

[73] Assignee: AGFA-Gevaert AG, Leverkusen, Fed. Rep. of Germany

[21] Appl. No.: 907,682

[22] Filed: Jul. 2, 1992

[30] Foreign Application Priority Data

Jul. 19, 1991 [DE] Fed. Rep. of Germany ..... 4123919

[51] Int. Cl.[5] ..... B41M 5/035; B41M 5/38

[52] U.S. Cl. ..... 503/227; 428/195; 428/500; 428/522; 428/913; 428/914

[58] Field of Search ..... 503/227; 428/195, 913, 428/914, 500, 522; 8/471

[56] References Cited

U.S. PATENT DOCUMENTS 4,720,480 1/1988 Ito et al. ..... 503/227
5,001,106 3/1991 Egashira et al. ..... 503/227

OTHER PUBLICATIONS

Masanori Akada, "High Quality Image Recording by Sublimation Transfer Material", *Electronic Photography Association Documents,* vol. 27, No. 2 (1988).

Database Japio, n084-150796, ORBIT Search JP-A-59150796, Mitsubishi Denki KK Aug. 29, 1984.

*Primary Examiner*—Pamela R. Schwartz
*Attorney, Agent, or Firm*—Connolly & Hutz

[57] ABSTRACT

A dye acceptor element for thermosublimation printing comprising a support and a dye acceptor layer containing a vinyl copolymer having a glass transition temperature of 50 to 100° C. and a plasticizer having a molecular weight MW of 150 to 1,000 is distinguished by high color density, high sharpness, good image stability and a minimal tendency towards adhesion.

2 Claims, No Drawings

ACCEPTOR ELEMENT FOR THERMOSUBLIMATION PRINTING

This invention relates to a dye acceptor element for thermosublimation printing.

Printouts of video- or computer-stored images can be made by a number of methods among which thermosublimation printing has proved to be superior for certain requirements by virtue of its advantages over other processes. This recording method is based on the heat-induced transfer of a dye from dye donor layer to a dye acceptor layer and is described, for example, in "High Quality Image Recording by Sublimation Transfer Recording Material", Electronic Photography Assocation Documents 27 (2), 1988 and in the literature cited therein. A particular advantage of this printing process is that it enables color intensity to be finely graduated.

Polymers of different classes may be used as the material for the dye acceptor layer.

Thus, the following examples of suitable materials for the acceptor layer are mentioned in EP-A-0 234 563:

1. synthetic resins containing ester bonds, such as polyesters, polyacrylates, polyvinyl acetate, styrene/acrylate resins and vinyl toluene/acrylate resins
2. polyurethanes
3. polyamides
4. urea resins
5. synthetic resins containing other highly polar bonds, such as polycaprolactam, styrene resins, polyvinyl chloride, vinyl chloride/vinyl acetate copolymers and polyacrylonitrile.

Polycarbonate, polyurethane, polyester, polyvinyl chloride, poly(styrene-co-acrylonitrile), polycaprolactone and mixtures thereof are mentioned as materials for the dye acceptor layer in U.S. Application No. 4,705,522.

EP-A-0 228 066 claims a dye acceptor layer having improved light stability which contains a mixture of polycaprolactone and a linear aliphatic polyester with poly(styrene-co-acrylonitrile) and/or bisphenol A polycarbonate.

U.S. Application No. 4,734,397 describes a dye receptor element containing a poly(styrene-co-acrylonitrile) layer. However, this layer is not used as a dye acceptor layer, but instead as a so-called compression layer.

The use of vinylidene chloride copolymers as an interlayer between the paper support and the dye acceptor layer is known from U.S. Application No. 4,748,150.

Japanese patent application No. 60/19 138 describes dye receptor layers containing polycarbonate and phthalic acid esters as plasticizer.

U.S. Application No. 4,871,715 describes receptor layers, preferably based on polycarbonate, which contain special phthalic acid esters.

The use of polycarbonate as a material for the dye acceptor layers is a disadvantage in ecological terms because these layers are generally applied from methylene chloride or other ecologically questionable solvents.

Processability from water or ecologically safe solvents would be desirable.

The dye acceptor layers available at the present time are not entirely satisfactory in regard to ready processability, high color density, high image stability and good resolution. It is particularly difficult in this regard to achieve high color density and adequate image stability for minimal lateral diffusion.

The problem addressed by the present invention was to provide a dye acceptor element for thermosublimation printing which would not have any of the disadvantages described above. This problem has been solved by the use of a special plasticized polymer in the acceptor element.

The present invention relates to a dye acceptor material for thermosublimation printing comprising a support and a dye acceptor layer which is characterized in that the dye acceptor layer contains a vinyl copolymer having a glass transition temperature Tg of 50° to 100° C. and a plasticizer having a molecular weight MW of 150 to 1,000.

In one preferred embodiment, the vinyl polymer consists of a) 10 to 80% by weight aromatic vinyl compound,
b) 5 to 40% by weight (meth)acrylonitrile,
c) 5 to 50% by weight (meth)acrylates,
d) 0 to 30% by weight other vinyl monomers.

In another preferred embodiment, the vinyl copolymer consists of e) 50 to 90% by weight vinyl halide,
f) 10 to 50% by weight vinyl ester,
g) 0 to 30% by weight other vinyl monomers.

The vinyl monomers are chosen with regard to the glass transition temperature Tg and solubility parameter values to be adjusted. The glass transition temperature of the vinyl copolymers is in the range from 50° to 100° C. and preferably in the range from 60° to 95° C. The solubility parameter should be in the range from 8 to 12 $(cal/cm^3)^{\frac{1}{2}}$. The Tg values and solubility parameters of important copolymers and also methods for calculating new copolymer compositions are described in the literature (for example in Polymer Handbook 3rd Ed., Brandrup and Immergut, John Wiley and Sons, New York, 1989).

Aromatic vinyl compounds suitable for the purposes of the invention are styrene, α-methyl styrene, *p*-methyl styrene, *m*-methyl styrene, *p*-tert. butyl styrene, *p*-chlorostyrene, *p*-chloromethyl styrene and vinyl naphthalene. Styrene is preferred.

The expression "(meth)acrylonitrile" is understood to encompass both methacrylonitrile and also acrylonitrile. The same applies to the expression "(meth)acrylates".

The (meth)arylates (component c) are derived from optionally substituted aliphatic, cycloaliphatic, aromatic or mixed aromatic-aliphatic alcohols. The aliphatic radicals may be both linear and branched and may also be interrupted by oxygen.

Examples of suitable (meth)acrylates are methyl acrylate, methyl methacrylate, ethyl acrylate, ethyl methacrylate, propyl acrylate, propyl methacrylate, isopropyl methacrylate, *n*-butyl acrylate, *n*-butyl methacrylate, isobutyl acrylate, isobutyl methacrylate, *n*-hexyl acrylate, *n*-hexyl methacrylate, ethylhexyl acrylate, ethylhexyl methacrylate, *n*-octyl acrylate, *n*-octyl methacrylate, decyl acrylate, decyl methacrylate, stearyl acrylate, stearyl methacrylate, cyclohexyl acrylate, cyclohexyl methacrylate, 4-tert. butyl cyclohexyl methacrylate, benzyl acrylate, benzyl methacrylate, phenylethyl acrylate, phenylethyl methacrylate, phenylpropyl acrylate, phenylpropyl methacrylate, phenyloctyl acrylate, phenylnonyl acrylate, phenylnonyl methacrylate, 3-methoxybutyl methacrylate, butoxyethyl acrylate, furfuryl methacrylate and tetrahydrofurfuryl acrylate.

Mixtures of different (meth)acrylates are also suitable. Mixtures containing ethylhexyl acrylate, decyl methacrylate, dodecyl methacrylate or phenylethyl acrylate are preferred.

Vinylidene chloride, vinyl chloride, vinyl acetate vinyl propionate, vinyl laurate and vinyl adipate are suitable as further monomers (component d).

The ratio by weight of component A to component B is important to the dyeability of the dye acceptor layer according to the invention. This ratio is from 1:1 to 4:1 and preferably from 2:1 to 4:1.

Suitable vinyl halides (component e) are vinyl chloride and vinyl bromide, vinyl chloride being preferred.

Suitable vinyl esters (component f) are the vinyl esters of $C_{2-20}$ carboxylic acids. Examples include vinyl acetate, vinyl propionate and vinyl butyrate. Vinyl esters of $C_{8-18}$ carboxylic acids, such as for example vinyl octoate, vinyl laurate and vinyl stearate, are preferred.

Other vinyl monomers (component g) are the (meth-)acrylates described above, also vinyl ethers, such as for example vinyl isobutyl ether, maleic acid esters, such as maleic acid diethyl ester, and vinylidene chloride, acrylonitrile and styrene.

If desired, important applicational properties may be controlled by means of component c) or e). For example, the use of long-chain alkyl (meth)acrylates or vinyl esters, such as for example decyl methacrylate or dodecyl methacrylate or vinyl stearate, leads to reduced tackiness of the dye acceptor material according to the invention.

The molecular weight (MW) of the copolymers is of the order of 10,000 to 1,000,000. The molecular non-uniformity is not critical, typical values being in the range from 2 to 4.

Examples of preferred compositions of the copolymer (quantities in % by weight) are shown in the Tables 1 and 2. These examples are not intended to limit the invention in any way.

TABLE 1

| a) | b) | c) | d) | e) | f) | g) |
|---|---|---|---|---|---|---|
| 60 S | 20 AN | 20 decyl methacrylate | — | 92 VC | 8 VAC | — |
| 55 S | 20 AN | 25 decyl methacrylate | — | 85 VC | 15 VAC | — |
| 56 S | 19 AN | 25 ethyl hexyl acrylate | — | 76 VC | 24 VAC | — |
| 52 S | 20 AN | 20 decyl methacrylate<br>8 furfuryl acrylate | — | 82 VC | 18 vinyl propionate | — |
| 55 S | 20 AN | 15 ethyl hexyl acrylate<br>10 phenyl ethyl methacrylate | — | 61 VC | 14 VA | 25 maleic acid diethyl ester |
| 50 S | 20 MAN | 30 decyl methacrylate | — | 57 VC | 20 VA | 23 maleic acid diethyl ester |
| 50 S | 20 AN | 15 decyl methacrylate | 15 VDC | | | |
| 45 S | 20 AN | 15 ethyl hexyl acrylate | 20 VDC | | | |
| 52 S | 16 AN | 10 decyl methacrylate<br>10 furfuryl acrylate | 12 VDC | | | |

S: styrene; AN: acrylonitrile; MAN: methacrylonitrile; VDC: vinylidene chloride; VC: vinyl chloride; VAC vinyl acetate The vinyl copolymers may be prepared by polymerization processes known per se, including for example bulk polymerization, solution polymerization, suspension polymerization and emulsion polymerization. These processesses are described in detail, for example, in Houben Weyl, Methoden der Organischen Chemie, Vol. E 20, Part 1.

An emulsion polymerization process using sodium alkyl sulfonate as emulsifier and potassium peroxydisulfate as initiator is particularly suitable. The polymer obtained may be precipitated by addition of electrolyte, for example magnesium sulfate. After thorough washing and drying, the polymer may be dissolved in a suitable solvent, for example acetone, methyl ethyl ketone, tetrahydrofuran, dioxane or ethyl acetate, to prepare the casting solution and, after addition of the plasticizer, may be processed to form the acceptor layer according to the invention.

In one particular embodiment, the polymerization reaction is carried out in the presence of the plasticizer. A plasticizer-containing copolymer dispersion is obtained in this way and may be directly used for the production of the dye acceptor layer.

Plasticizers in the context of the invention are liquid or solid, inert substances having a low vapor pressure and a molecular weight in the range from 150 to 1,000. They interact with high polymers without a chemical reaction, preferably through their dissolving or swelling power, and form a homogeneous physical system therewith.

Suitable plasticizers are, primarily, derivatives of organic and inorganic acids, more particularly esters, amides and imides of organic acids. Esters and imides containing $C_{4-12}$ alkyl units are particularly preferred.

Examples of such plasticizers are abietic acid ester, adipic acid ester, azelaic acid ester, benzoic acid ester, butyric acid ester, esters of higher fatty acids, epoxidized fatty acid esters, glycolic acid esters, phthalic acid esters, isophthalic acid esters, terephthalic acid esters, propionic acid esters, sebacic acid esters, trimellitic acid esters, citric acid esters, phosphoric acid esters and sulfonic acid esters.

The alkyl and aryl esters of hydroxy acids, such as hydroxybenzoic acid and salicylic acid, and N-alkyl phthalimides are also suitable.

The following plasticizers, for example, are very suitable: di-2-ethylhexyl adipate, diisoctyl adipate, diisodecyl adipate, benzyl octyl adipate, di-2-ethylhexyl azelate, dibutyl phthalate, dicapryl phthalate, dioctyl phthalate, di-2-ethylhexyl phthalate, diisooctyl phthalate, butylbenzyl phthalate, dinonyl phthalate, diisononyl phthalate, diisodecyl phthalate, diisotridecyl phthalate, di-2-ethylhexyl isophthalate, di-2-ethylhexyl terephthalate, diisooctyl sebacate, triisooctyl trimellitate, salicylic acid methyl ester, salicylic acid phenyl ester, butyl phthalimide, 4-hydroxybenzoic acid n-propyl ester, tri-2-ethylhexyl phosphate, triphenyl phosphate, diphenyloctyl phosphate, diphenylcresyl phosphate, tricresyl phosphate and alkylsulfonic acid esters of phenol and cresol.

In addition to the low molecular weight compounds mentioned above, other suitable plasticizers according to the invention are oligomers containing no more than four recurring units, for example oligomers of aliphatic or aromatic polyesters based, for example, on adipic acid, succinic acid, sebacic acid, phthalic acid and hexahydrophthalic acid as the acid component and, for example, ethylene glycol, 1,2-propylene glycol, butane-1,4-diol, hexane-1,6-diol, octane-1,8-diol and cyclohexane dimethanol as the hydroxy component. Other suitable plasticizers are oligomers of hydroxycarboxylic acids, such as for example polycaprolactone, polyhydroxystearic acid and polyhydroxybutyric acid, and polyols, such as for example polyethylene oxide, polypropylene oxide, polybutylene oxide and co-oligomers thereof.

The plasticizer is used in a quantity of 2 to 20% by weight and preferably 4 to 15% by weight, based on the vinyl copolymer. If the quantity of plasticizer is too small, a density-increasing effect is hardly obtained. If, on the other hand, the quantity of plasticizer is too large, a marked tendency towards adhesion or a reduction in image sharpness is often observed.

Various materials may be used as supports for the dye acceptor layers. It is possible to use transparent films, such as for example polyethylene terephthalate, polycarbonate, polyether sulfone, polyolefin, polyvinyl chloride, polystyrene, cellulose or polyvinyl alcohol copolymer films. Reflective supports, such as the various types of papers, for example polyolefin-coated paper or pigmented papers, may of course also be used. Laminates of the materials mentioned above are also suitable supports. Typical combinations are laminates of cellulose paper and synthetic paper or cellulose paper and polymer films or polymer films and synthetic paper or even other combinations.

The supports provide for the necessary mechanical stability of the dye acceptor element. If the dye acceptor layer has sufficient mechanical stability, there may be no need for an additional support.

The mixture from which the dye acceptor layers according to the invention are produced is normally processed from solution. Suitable solvents are, for example, methyl ethyl ketone, toluene, xylene, butyl acetate, methylene chloride, chlorobenzene, tetrahydrofuran or dioxane. The solution may be applied by casting or knife coating or by printing onto the support. The coating may then be heated to remove the solvent. The heating conditions are governed by the particular circumstances of each individual case, for example by the type of support and solvent used and the layer thickness.

The dye acceptor layers according to the present invention preferably have overall layer thicknesses of 0.3 to 50 μm and, more preferably, 0.5 to 10 μm where a support of the type described above is used or—in the absence of such a support—3 to 120 μm. The dye acceptor layer may consist of a single layer although two or more layers may also be applied to the support. Where transparent supports are used, they may be coated on both sides to increase color intensity, as described for example in European patent application 90 200 930.7.

The dye acceptor layer may contain pigments or mixtures of several pigments, such as for example titanium dioxide, zinc oxide, kaolin, clay, calcium carbonate or Aerosil, in order for example to increase image sharpness or to improve whiteness.

If necessary, one or more kinds of additive, such as for example UV absorbers, light stabilizers or antioxidants, may be added in order further to increase the light stability of the transferred image.

The dye acceptor layers according to the present invention may contain a lubricant to improve the abhesive properties, primarily between the donor element and the acceptor element. For example, solid waxes, such as polyethylene wax, amide waxes or Teflon powder may be used for this purpose, although fluorine-containing surfactants, paraffin oils, silicone oils or fluorine-containing oils or silicone-containing copolymers, such as polysiloxane/polyether copolymers, may also be used as lubricants.

The lubricant mentioned may even be applied as a separate coating, for example in the form of a dispersion or in the form of a solution in a suitable solvent as a top coat. The thickness of such a layer is preferably from 0.01 to 5 μm and more preferably from 0.05 to 2 μm.

The dye acceptor element according to the present invention may also contain various interlayers between the support and actual the dye acceptor layer. Depending on the specific properties of the material used, the interlayer may act as an elastic layer, as a barrier layer for the dye transferred or even as a binder layer, depending on the particular application. Suitable materials are, for example, urethane, acrylate or olefin resins and also butadiene rubbers or epoxides. The thickness of this interlayer is normally between about 1-2 and 20 μm. The function of the diffusion barrier layers is to prevent the transferred dyes from diffusing into the support. Materials which perform this function may be soluble in water or in organic solvents or in mixtures. Suitable materials are, for example, gelatine, polyacrylic acid, maleic anhydride copolymers, polyvinyl alcohol, polyvinyl chloride copolymers or cellulose acetate.

The additional layers optionally present, such as the elastic layer, the diffusion barrier layer, the binder layer, etc., and the actual dye acceptor layer may contain, for example, silicate, clay, aluminium silicate, calcium carbonate, calcium sulfate, barium sulfate, titanium dioxide or aluminium oxide powder.

The dye acceptor elements according to the invention may also be antistatically treated in the usual way on the front or back. In addition, they may be provided with markings, preferably on the back of the support, in order to achieve exact positioning during the printing process.

The dye acceptor element according to the invention may be combined with any of the dye donor elements typically used in thermosublimation printing.

The dye images obtained in a thermosublimation printer are distinguished by high resolution, high color densities, high brilliance and good long-term stability.

EXAMPLES

Example 1

General procedure for the preparation of vinyl copolymers 3.0 g emulsifier (Mersolat MK 30) dissolved in 300 g deionized water are introduced into a 1 liter stirred reactor. After the solution has been heated with stirring (200 r.p.m.) under nitrogen to a temperature of 70° C., 25 g of the monomer mixture are added. The polymerization is initiated by addition of a solution of 0.5 g potassium peroxydisulfate in 20 g deionized water. After the reaction has started, another 250 g of the monomer mixture, to which 0.05 g dodecyl mercaptan has been added, and - in a separate inflow—a solution of 0.75 g potassium peroxydisulfate and 4.0 g Mersolat MK 30 in 200 g water are added over a period of 6 hours. 0.75 g potassium peroxydisulfate dissolved in 15 g deionized water are then added and the temperature is kept at 75° C. for 8 hours.

EXAMPLE 2

Production of dye acceptor elements and testing

Plasticizer was added to the copolymers in the quantity indicated, after which the copolymers were dissolved in methyl ethyl ketone (10% solids). The 10% copolymer solutions were knife-coated in a wet film thickness of 50 μm onto gelatine-coated polyethylene paper.

The coatings were dried at room temperature and then heated for 15 minutes at 90° C. The dry layer thicknesses were approximately 4.5 μm.

Test images were produced on the dye acceptor elements obtained with a Mitsubishi CP-100 E video printer using a Mitsubishi CK-100S dye cassette. The color intensities were determined by microdensimetry. The FIGURES shown are the density values (density) measured without a filter in a black image region of the test image.

Image sharpness was visually evaluated immediately after printing, after storage for 3 days at 57° C./35% relative air humidity (sharpness 1) and after storage for 3 days at room temperature (sharpness 2).

In Table 3, M1.1, M1.2, M1.3 and M1.4 represent the various monomer components in the vinyl copolymer according to the invention (quantities in % by weight):

AN: acrylonitrile
S: styrene
EHA: ethyl hexyl acrylate
C10MA: decyl methacrylate
++very sharp
+sharp

TABLE 3

| Sample No. | Polymer composition M1.1 | % M1.1 | M1.2 | % M1.2 | M1.3 | % M1.3 | M1.4 | % M1.4 | Plasticizer | % P | Density | Sharpness 1 3d/57° C. | Sharpness 2 S-3d/RT |
|---|---|---|---|---|---|---|---|---|---|---|---|---|---|
| 1 | AN | 25 | S | 75 | | | | | None | 0 | 1.45 | ++ | ++ |
| 2 | AN | 25 | S | 75 | | | | | Dioctyl phthalate | 5 | 1.64 | ++ | ++ |
| 3 | AN | 25 | S | 75 | | | | | Dioctyl phthalate | 10 | 1.75 | ++ | ++ |
| 4 | AN | 35 | S | 65 | | | | | None | 0 | 1.5 | ++ | ++ |
| 5 | AN | 35 | S | 65 | | | | | Dioctyl phthalate | 5 | 1.62 | ++ | ++ |
| 6 | AN | 35 | S | 65 | | | | | Dioctyl phthalate | 10 | 1.75 | ++ | ++ |
| 7 | AN | 20 | S | 40 | EHA | 25 | VDC | 15 | None | 0 | 1.83 | ++ | ++ |
| 8 | AN | 20 | S | 40 | EHA | 25 | VDC | 15 | Dioctyl phthalate | 3 | 1.92 | ++ | ++ |
| 9 | AN | 20 | S | 40 | EHA | 25 | VDC | 15 | Dioctyl phthalate | 6 | 1.98 | ++ | ++ |
| 10 | AN | 20 | S | 45 | C10MA | 20 | VDC | 15 | None | 0 | 1.81 | ++ | ++ |
| 11 | AN | 20 | S | 45 | C10MA | 20 | VDC | 15 | Dioctyl phthalate | 5 | 1.86 | ++ | ++ |
| 12 | AN | 20 | S | 45 | C10MA | 20 | VDC | 15 | Dioctyl phthalate | 10 | 1.97 | ++ | ++ |
| 13 | AN | 25 | S | 50 | C10MA | 25 | | | None | 0 | 1.64 | ++ | ++ |
| 14 | AN | 25 | S | 50 | C10MA | 25 | | | Dioctyl phthalate | 5 | 1.75 | + | ++ |
| 15 | AN | 25 | S | 50 | EHA | 25 | | | None | 0 | 1.6 | ++ | ++ |
| 16 | AN | 25 | S | 50 | EHA | 25 | | | 1-(4-Methoxyphenyl)1-propanone | 5 | 1.89 | ++ | ++ |
| 17 | AN | 25 | S | 50 | EHA | 25 | | | 2-Methoxynaphthalene | 5 | 1.77 | + | + |
| 18 | AN | 25 | S | 50 | EHA | 25 | | | 4-Hydroxybenzoic acid n-propylester | 5 | 1.91 | + | + |
| 19 | AN | 25 | S | 50 | EHA | 25 | | | n-Octyl phthalimide | 5 | 1.96 | ++ | ++ |
| 20 | AN | 25 | S | 50 | EHA | 25 | | | Paraffin sulfonic acid phenylester (Mesamoll*) | 17 | 1.97 | + | ++ |
| 21 | AN | 25 | S | 50 | EHA | 25 | | | Paraffin sulfonic acid phenylester (Mesamoll*) | 5 | 1.9 | ++ | ++ |
| 22 | AN | 25 | S | 50 | EHA | 25 | | | Paraffin sulfonic acid phenylester (Mesamoll*) | 8 | 1.89 | ++ | ++ |
| 23 | AN | 25 | S | 50 | EHA | 25 | | | Benzyloctyl adipate | 5 | 1.67 | ++ | ++ |
| 24 | AN | 25 | S | 50 | EHA | 25 | | | Benzyloctyl adipate | 8 | 1.71 | ++ | ++ |
| 25 | AN | 25 | S | 50 | EHA | 25 | | | Benzyloctyl adipate | 12 | 1.82 | + | ++ |
| 26 | AN | 25 | S | 50 | EHA | 25 | | | Benzylbutyl phthalate | 5 | 1.89 | ++ | ++ |
| 27 | AN | 25 | S | 50 | EHA | 25 | | | Benzylbutyl phthalate | 12 | 1.97 | ++ | ++ |
| 28 | AN | 25 | S | 50 | EHA | 25 | | | Benzylbutyl phthalate | 8 | 1.96 | ++ | ++ |
| 29 | AN | 25 | S | 50 | EHA | 25 | | | Diisodecyl phthalate | 8 | 1.7 | ++ | ++ |
| 30 | AN | 25 | S | 50 | EHA | 25 | | | Diisodecyl phthalate | 5 | 1.65 | ++ | ++ |
| 31 | AN | 25 | S | 50 | EHA | 25 | | | Diisodecyl phthalate | 12 | 1.82 | + | ++ |
| 32 | AN | 25 | S | 50 | EHA | 25 | | | Dioctyl phthalate | 5 | 1.9 | +− | ++ |
| 33 | AN | 25 | S | 50 | EHA | 25 | | | Diphenyl cresyl phosphate | 8 | 1.73 | ++ | ++ |
| 34 | AN | 25 | S | 50 | EHA | 25 | | | Diphenylcresyl phosphate | 12 | 1.82 | ++ | ++ |
| 35 | AN | 25 | S | 50 | EHA | 25 | | | Diphenylcresyl phosphate | 5 | 1.62 | ++ | ++ |
| 36 | AN | 25 | S | 50 | EHA | 25 | | | Diphenyloctyl phosphate | 8 | 1.83 | ++ | ++ |
| 37 | AN | 25 | S | 50 | EHA | 25 | | | Diphenyloctyl phosphate | 5 | 1.73 | ++ | ++ |
| 38 | AN | 25 | S | 50 | EHA | 25 | | | Diphenyloctyl phosphate | 12 | 2.01 | ++ | ++ |
| 39 | AN | 25 | S | 50 | EHA | 25 | | | Methyl salicylate | 5 | 1.71 | ++ | ++ |
| 40 | AN | 25 | S | 50 | EHA | 25 | | | Salicylic acid phenyl ester | 5 | 1.71 | ++ | ++ |
| 41 | NA | 19 | S | 56 | EHA | 25 | | | None | 0 | 1.64 | ++ | ++ |
| 42 | AN | 19 | S | 56 | EHA | 25 | | | 1-(4-Methoxyphenyl)1-propanone | 5 | 1.79 | ++ | ++ |
| 43 | AN | 19 | S | 56 | EHA | 25 | | | 2-Methoxynaphthalene | 5 | 1.86 | ++ | ++ |
| 44 | AN | 19 | S | 56 | EHA | 25 | | | 4-Hydroxybenzoic acid n-propylester | 5 | 1.75 | ++ | ++ |
| 45 | AN | 19 | S | 56 | EHA | 25 | | | n-Octyl phthalimide | 5 | 1.86 | ++ | ++ |
| 46 | AN | 19 | S | 56 | EHA | 25 | | | Benzylbutyl phthalate | 8 | 1.77 | + | + |
| 47 | AN | 19 | S | 56 | EHA | 25 | | | Benzylbutyl phthalate | 5 | 1.67 | + | + |
| 48 | AN | 19 | S | 56 | EHA | 25 | | | Diphenylcresyl phosphate | 5 | 1.63 | ++ | ++ |
| 49 | AN | 19 | S | 56 | EHA | 25 | | | Diphenylcresyl phosphate | 8 | 1.71 | ++ | ++ |
| 50 | AN | 19 | S | 56 | EHA | 25 | | | Diphenyloctyl phosphate | 8 | 1.89 | + | ++ |
| 51 | AN | 19 | S | 56 | EHA | 25 | | | Diphenyloctyl phosphate | 5 | 1.8 | ++ | ++ |

TABLE 3-continued

| Sample No. | Polymer composition M1.1 | % M1.1 | M1.2 | % M1.2 | M1.3 | % M1.3 | M1.4 | % M1.4 | Plasticizer | % P | Density | Sharpness 1 3d/57° C. | Sharpness 2 S-3d/RT |
|---|---|---|---|---|---|---|---|---|---|---|---|---|---|
| 52 | AN | 19 | S | 56 | EHA | 25 | | | Methyl salicylate | 5 | 1.77 | ++ | ++ |
| 53 | AN | 19 | S | 56 | EHA | 25 | | | Salicylic acid phenyl ester | 5 | 1.83 | ++ | ++ |
| 54 | Solvic 560 RA (VC/VA copolymer of Solvay) | | | | | | | | None | 0 | 1.68 | ++ | ++ |
| 55 | Solvic 560 RA (VC/VA copolymer of Solvay) | | | | | | | | Dioctyl phthalate | 15 | 1.85 | ++ | ++ |
| 56 | Solvic 560 RA (VC/VA copolymer of Solvay) | | | | | | | | Dioctyl phthalate | 10 | 1.79 | ++ | ++ |
| 57 | Solivc 560 RA (VC/VA copolymer of Solvay) | | | | | | | | Dioctyl phthalate | 5 | 1.7 | ++ | ++ |

*Mesamoll is a product of Bayer AG, Leverkusen

We claim:

1. A dye acceptor element for thermosublimation printing comprising a support and a dye acceptor layer, characterized in that the dye acceptor layer consists of a vinyl copolymer and of 2 to 20% by weight, based on the vinyl copolymer, of a plasticizer having a molecular weight MW of 150 to 1,000, wherein said vinyl copolymer has a glass transition temperature Tg in the range from 50 to 100° C. and a solubility parameter in the range from 8 to 12 $(cal/cm^3)^{\frac{1}{2}}$, and is selected from the group consisting of a vinyl copolymer consisting of a) 10 to 80% by weight aromatic vinyl compound,
b) 5 to 40% by weight (meth)acrylonitrile,
c) 5 to 50% by weight (meth)acrylates,
d) 0 to 50% by weight other vinyl monomers, and a vinyl copolymer consisting of
e) 50 to 90% by weight vinyl halide,
f) 10 to 50% by weight vinyl ester,
g) 0 to 30% by weight other vinyl monomers.

2. A dye acceptor element as claimed in claim 1, characterized in that the plasticizer is an ester, amide or imide of an organic acid.

* * * * *